US008695835B2

(12) United States Patent
Timmer

(10) Patent No.: US 8,695,835 B2
(45) Date of Patent: Apr. 15, 2014

(54) CLOSURE CAP FOR A FLUID CONTAINER AND METHOD FOR THE FABRICATION

(75) Inventor: Hartmuth Timmer, Weener-Holthusen (DE)

(73) Assignee: Weener Plastik GmbH, Weener (DE)

( * ) Notice: Subject to any disclaimer, the term of this patent is extended or adjusted under 35 U.S.C. 154(b) by 0 days.

(21) Appl. No.: 13/365,340

(22) Filed: Feb. 3, 2012

(65) Prior Publication Data

US 2012/0199589 A1 Aug. 9, 2012

Related U.S. Application Data

(60) Provisional application No. 61/439,031, filed on Feb. 3, 2011.

(51) Int. Cl.
*B65D 53/02* (2006.01)

(52) U.S. Cl.
USPC ..... 220/378; 215/344; 401/213

(58) Field of Classification Search
USPC ..... 220/378, 203.21, 304; 401/213
See application file for complete search history.

(56) References Cited

U.S. PATENT DOCUMENTS 1,120,325 A * 12/1914 Miraldi ..... 220/256.1
2,383,089 A * 8/1945 Theiler ..... 285/55
2,807,817 A * 10/1957 Ackerman ..... 401/213
2,910,712 A * 11/1959 Schaich et al. ..... 401/213
2,997,731 A * 8/1961 Schultz ..... 401/213
2,998,616 A * 9/1961 Gentile ..... 401/213
3,090,987 A * 5/1963 Ruekberg ..... 401/213
4,002,411 A * 1/1977 Harbauer ..... 401/213
4,030,844 A * 6/1977 Lench et al. ..... 401/213
4,221,494 A * 9/1980 Kachur ..... 401/213
4,308,965 A * 1/1982 Dutt ..... 215/345
4,475,837 A * 10/1984 Dornbusch et al. ..... 401/213
4,840,511 A * 6/1989 Fattori et al.
5,051,017 A * 9/1991 Yorks ..... 401/209
5,248,213 A * 9/1993 Seager et al. ..... 401/208
6,626,310 B2 * 9/2003 Taha ..... 215/252
6,769,699 B2 * 8/2004 Seki et al. ..... 277/628
8,221,018 B2 * 7/2012 Steinhagen et al. ..... 401/216

FOREIGN PATENT DOCUMENTS

CA 1207278 * 7/1986 ..... B05C 17/02

* cited by examiner

*Primary Examiner* — J. Gregory Pickett
*Assistant Examiner* — Mollie Llewellyn
(74) *Attorney, Agent, or Firm* — Preti Flaherty Beliveau & Pachios LLP

(57) ABSTRACT

Closure cap (1) for a fluid container (30), which has a receiver (31), at which an applicator body (32) is movably supported, wherein the closure cap has a sealing element for contacting the receiver and/or the applicator body and has a cap base body (10) with an axial support (20, 20'), and wherein the sealing element and at least a part of the support are connected to each other by material bond.

11 Claims, 3 Drawing Sheets

Figure 3:
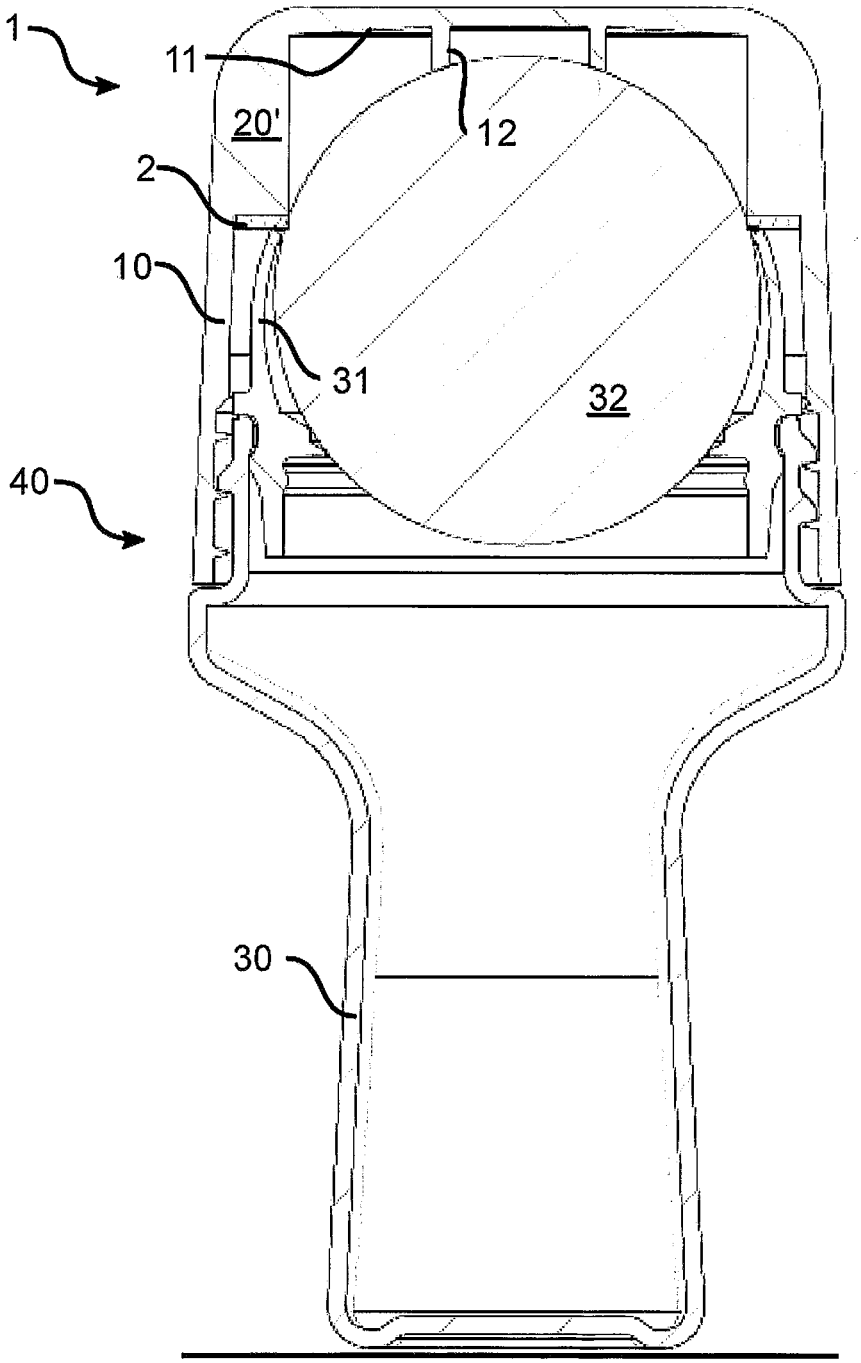

Fig. 1A
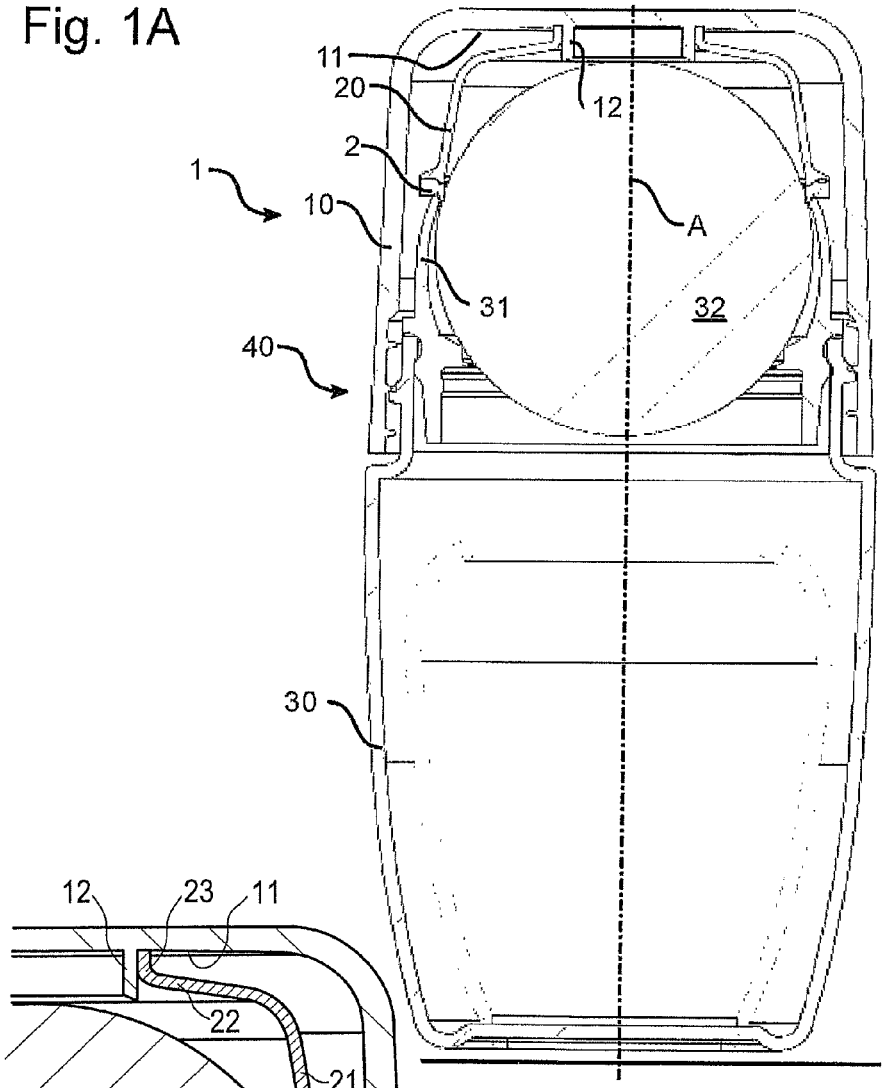
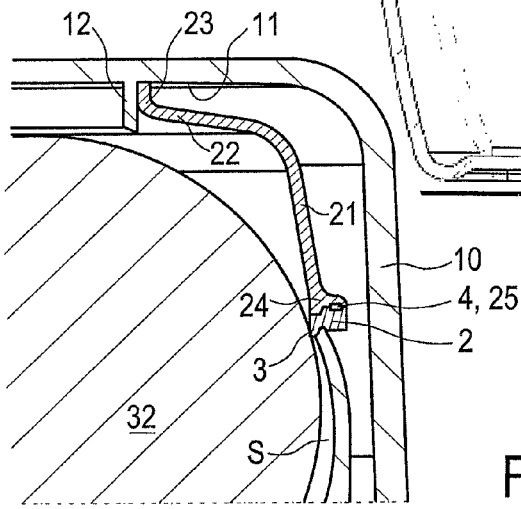
Fig. 1B

Fig. 2A
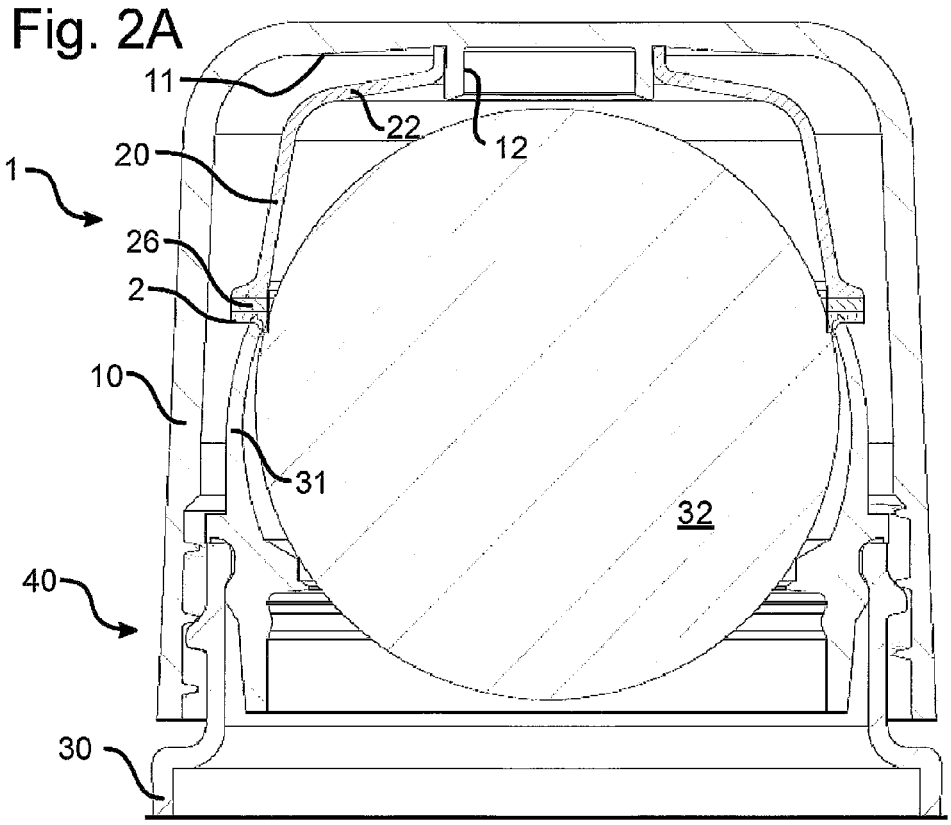
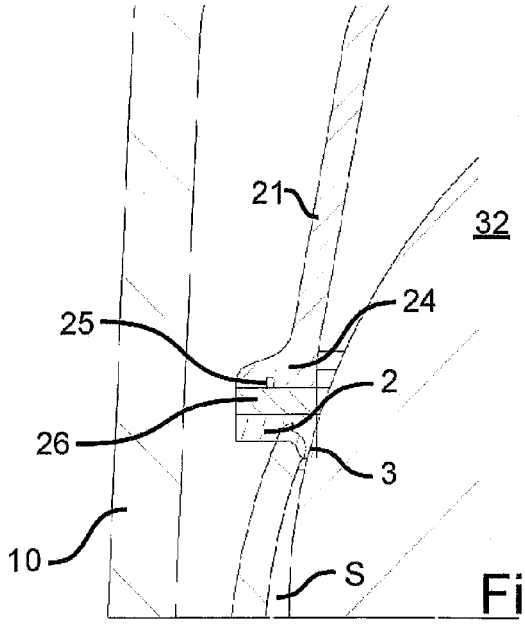
Fig. 2B

CLOSURE CAP FOR A FLUID CONTAINER AND METHOD FOR THE FABRICATION

The present invention is related to a closure cap for a fluid container, fluid container arrangement and a method for the fabrication of such a closure cap.

Fluid container arrangements of said kind are known for use as sanitary products, like roll-ons, at which an applicator body, mostly a ball, is movably supported at a receiver of the fluid container. Following the movement of the applicator body, an area of the applicator body, which is first facing the inside of the container and thereby is wetted by the fluid, is brought into a position, which is accessible from outside, and can dispense, in said position, the fluid, for example a liquid deodorant.

In particular for the purpose of transport, it is known to close the fluid container in the case of non-use by a closure cap, which prevents an unintended contact with the applicator body. High demands are made on the sealing of the inside of the fluid container provided by the closure cap, in particular in the case of non-use, when the fluid container arrangement is stored in an upside-down position, in which the applicator body is arranged underneath the fluid container with respect to the direction of gravity, in order to achieve reliable wetting of the applicator body and thereby achieve immediate readiness of operation.

Hence, receiver-sited sealings are known, for example from WO 2005/079621 A1, wherein, in the closed condition, the closure cap tightens the applicator body against the sealing at the receiver and/or deforms the same against the applicator body.

Known from the U.S. Pat. No. 4,475,837, is a closure cap, in which a porous, ring-shaped absorption element is mounted, which, in the closed condition, catches the escaped fluid, which has overcome a receiver-sited primary sealing. The absorption element is detachably mounted in the closure cap, by being attached on a ring pin and being secured there in a form-fit manner with an axial play, such that it is guaranteed that the primary sealing is sufficiently elastically compressed in the closed condition.

The invention is based on the problem to provide an improved fluid container arrangement with a closure cap.

According to the invention, said problem is solved by the teaching of the independent claims. Preferred embodiments of the invention are subject matters of the sub claims.

A fluid container arrangement according to the present invention has a fluid container and a closure cap according to the invention, and is applicable, in particular, for sanitary products like deodorants and the like.

The fluid container has a receiver, at which an applicator body is movably supported. The applicator body, preferably, can have a, at least substantially, sphere-shaped or cylindrical, in particular circular-cylindrical, jacket surface and can rotate within the receiver around an axis of symmetry of said jacket surface, which receiver preferably encloses here the applicator body in part. The one-piece or multipart receiver, which preferably is at least substantially ring-shaped, can be formed integrally with the fluid container, in particular master-formed with the same, preferably by injection moulding, or being fabricated separately and removable, for example by screwing, or unremovable, in particular by material bond (German: stoffschlüssig), preferably by adhesive bonding or fusion, being connected with the fluid body. In a preferred embodiment, the receiver is formed elastically for allowing to insert the applicator body in the receiver by the elastic deformation of the receiver.

The closure cap has a cap base body, which can be mounted removably at the fluid container and/or the receiver. For this purpose, in a preferred embodiment, the cap base body and/or the fluid container or, respectively, the receiver, have corresponding complementary fastening means, preferably a screw connection and/or a interlocking connection, in particular a bayonet connector. Preferably, the cap base body is, at least substantially, formed cap-shaped and has, at least substantially, planar axial front surface for allowing to stably support the fluid container arrangement in an upside-down position. In general, the outer contour of the closure cap, in a preferred embodiment of the present invention, has three or more contact points, of which at least three, respectively, are arranged in a plane, for allowing an upside-down position. Regarding the previously described planer axial front surface, the points of the same are forming such contact points. Nevertheless, contact points can, for example, be also defined by protrusions or edges of recesses, wherein the closure cap otherwise has a curved outer contour. The cap base body can be configured closed, in particular fluid-sealed, apart from a receiving opening for the fluid container. For this purpose, in a preferred embodiment, fastening means of the cap base body and/or the fluid container, or respectively, the receiver, are formed in a fluid-sealing manner. Similarly, the cap base body can also have one or more passages or more passages and can just serve for the storage and/or the mechanical protection of the applicator body. In this regard, the term "closure cap" does not state a delimitation of the part regarding its shape.

The closure cap has at least one sealing element, which, preferably, has a lower stiffness than the cape base body, and which, in the closed condition of the fluid container arrangement, contacts the receiver and/or the applicator body under elastic forming or, respectively, deformation, for reducing a fluid gap between said parts or, preferably, closing the same in a fluid-sealing manner. Preferably, the sealing element, in the closed condition of the fluid container arrangement, is elastically tightened against the receiver and/or the applicator body. According to standard definition, a lower stiffness refers to a higher elastic axial compression under an axial nominal load, in particular. Preferably, the sealing element is non-porous with reference to the fluid to be sealed, such that the fluid is not enter into the same or only into an upper layer of the sealing element.

The cap base body has an axial support, at which the sealing element is axially supported. The axial support can be mounted removably, in particular by form-fit and/or force-fit, preferably frictionally engaged, at the cap base body. In a preferred embodiment, the support can have one or more recesses, in particular through borings, and/or protrusions, which interact in the mounted condition by form-fit and/or frictional engagement with corresponding protrusions or, respectively, recesses at the cap base body, for fastening the support at the cap base body. This can allow, in particular, an alternative equipping and/or retrofitting of existing base bodies by corresponding supports. Hereby, the mounting of an axial support at the base body is understood to be at least one fixation in axial direction. In circumferential direction, the support can be formed rotatable at the base body or can be fixed at the same, wherein a rotatable mounting provides an advantages degree of freedom for the compensation of tolerances, while an non-rotatable mounting can improve the distribution of forces and the guidance of the support. A non-rotatable mounting can be formed, in particular, by form-fit, for example, by protrusions or, respectively, recesses, which are not rotationally symmetrical and are, in particular, formed oval or angular.

Alternatively, the axial support can be permanently connected with the base body. For this purpose, the axial support can likewise be fabricated as an especially separated one-piece or multipart building part and can be mounted, subsequently, at the cap base body, preferably by material bond, for example by adherence, by injecting to each other or respectively injecting onto each other, and/or by fusion onto each other or respectively welding, or the axial support can be formed integral with the cap base body, in particular as an one-step or multistep radial or inclined bench, in particular by master-forming. A permanent connection can promote an advantageous distribution of forces and stable support.

According to the invention, the sealing element and the support, are, in case of a multipart support at least a part of the support, connected to each other by material bond. Hereby, the sealing element is undetachably fixed at the support or respectively its part, which can be advantageous, in particular, for an improved handling of disk-shaped sealing elements. Likewise, a material bond connection can effect an improved distribution of forces and can lead to a favourite distribution of tension and thereby to an improved sealing characteristic of the supported sealing element. Also the kinematics of closure can be improved by a sealing element, which is connected by material bond, if the cap-sited sealing comes in contact with the applicator body and/or the receiver.

A material bond connection can be achieved by an adhesive between the sealing element and the support. In a preferred embodiment, the sealing element and the support, or respectively its part, a directly connected to each other by material bond. This must be understood to mean, in the present case, in particular, a material bond connection without the use of adhesive between the sealing element and this support.

Such a direct material bond connection can be achieved, in particular, thermally, wherein the sealing element and/or the support or respectively its part contact the other partner in a heated condition and are allowed to cool down in this condition, preferably under contact pressure. For example, the support, or in case of a multipart support at least a part of the support, can be heated by means of irradiation, a heating bath, a heating device or the like, can contact the sealing element in this condition and can be pressed against the same and can cool down this position, afterward. Likewise, the sealing element and/or the support or respectively its part can be friction welded by a relative movement.

In particular, when the sealing element and/or the support or its part a master-formed in a heated condition, in particular injection moulded, the sealing element and at least a part of the support can be directly connected thermally by material bond with each other, wherein, preferably, a separate heating for achieving the material bond connection can be omitted. In a preferred embodiment, the sealing element is arranged in a form or is master-formed in the same, in which form afterward the support or, respectively, its part is master-formed, preferably by injection moulding, such that the sealing element is connected to the support or its part by material bond by injecting them to each other or injecting the same onto each other. Of course, vice versa, the support or its part can also be arranged in a form or can be master-formed in the same, in which afterward the sealing element is master-formed.

As described before, the support can be formed one-piece or multipart. In the latter case, the axial support has at least one support base body, which is connected to the cap base body removably or permanent, in particular formed integral, and has at least one connecting part, which is connected to the sealing element by material bond. The connecting part, in a preferred embodiment, is made from another material than the support base body. This way, a mounting of the sealing element by material bond can be achieved also in case of an inappropriate combination of materials of support base body and sealing element. This way, the support base body and the sealing element can be optimized, respectively, for example with reference to their respective elasticity, its weight and its material cost or the like.

Connecting part and support base body can be mounted permanently or removably to each other, preferably by material bond, force-fit and/or form-fit, for example by means of adhesive-, welding-, interlocking- and and/or a tongue-and-groove joint. In particular, the connecting part can be connected to the support base body, as its was already described before for the connection of the sealing element and the connecting part of the support, and therefore, in particular, by arranging the connecting part, which preferably is already be connected to the sealing element, in the form, in which afterwards the support base body is master-formed, preferably by injection moulding. Likewise, a support base body can be arranged in a form, in which afterwards the connecting part is master-formed, preferably by injection moulding, and for afterwards connecting the same by material bond to the sealing element. As can be understood from the above, a material bond connection of the connecting part is also preferred with the support base body, however, connecting part and support base body can be mounted to each other also by force-fit and/or form-fit, in addition or alternatively.

In preferred embodiment, the sealing element comprises silicon and/or one or multiple thermoplastic elastomers ("TPE") and preferably consists of the same. A thermoplastic elastomer, or respectively, a thermoplastically processable elastomer is understood to be, in particular according to standard definitions, a polymer, which at room temperature behaves similar to classical elastomers, which, however, can be plastically deformed under the provision of heat and thereby shows a thermoplastic behaviour. In particular, the sealing element can comprise blockcopolymere, for example SBS, SIS, and/or elastomers alloys, for example polyolefin-elastomer or polypropylene or natural rubber (NR). In a preferred embodiment, the sealing element comprises one or more thermoplastic elastomers from one or multiple of the following groups: thermoplastic elastomer on olefin basis or, respectively, polyolefin basis ("TPE-O" or respectively, "TPO"), interconnected thermoplastic elastomers on olefin basis ("TPE-V" or "TPV"), thermoplastic elastomers on urethan basis ("TPE-U" or "TPC"), styrol-blockcopolymers ("TPE-S" or "TPS"), thermoplastic copolyamids or respectively, polyetheramides ("TPE-A" or respectively, "TPA").

A one-piece support element, in case of a multipart support element a support element base body, comprises, preferably, a thermoplast, in particular polyoxymethylen (POM), and preferably consists of the same. A connecting part of a multipart support element preferably comprises a thermoplast, in particular polypropylen (PP), and preferably consists of the same. Also the closure cap base body preferably comprises a thermoplast, in particular PP, and, in a preferred embodiment, consists of the same, wherein a support, which is formed integral with the cap base body or, respectively, a support base body, which is formed integral with the cap base body, preferably, consists of PP.

In particular a material bond connection of a sealing element out from one of the previously described materials silicon and/or TPE with a support made from POM, optionally under interposition of a connecting part from PP or a support formed integral with a closure cap made from PP, can combine the advantages material properties coexisting with a preferred characteristic of sealing and closure.

In a preferred embodiment, the axial support, in comparison with the fluid container and in comparison to the closure cap mounted to the same, is formed such that the axial support is elastically deformed in the closed condition of the fluid container arrangement or respectively is deformed, for tightening the sealing element against the applicator body or, respectively, its receiver. This way, in combination with its elasticity, a wide range can be achieved, in which the elasticity characteristic and, thereby the sealing characteristic of the sealing element and the support, which is arranged axially in series with the same, can be predetermined or, respectively, adjusted. In order to elastically deform the axial support in the closed condition, in a preferred embodiment, in addition or alternatively to an appropriate material and/or a wall thickness of the support, the support can also be chosen appropriate. In general, in a preferred embodiment, a support is provided, which has one or multiple areas, which extend, at least substantially, normal or, respectively, perpendicular to the axial direction, and/or one or more areas, which, at least substantially, extend in parallel to the axial direction. In a further preferred embodiment, the support is formed at least cup-shaped, when the support is supported by a bottom, which can be closed, but which can also have recesses, or with the projection, which is joining the same and which preferably is ring-shaped, supported at the cap base body, and wherein the sealing element is mounted at the edge of the cup, optionally under the interposition of a connecting part.

In a preferred embodiment, the sealing element, is, at least substantially, disk-shaped and has, preferably, a minimal axial lengths, which is at maximum 10% of the extension of the applicator body in the axial direction, for example corresponding to the diameter of a sphere-shaped applicator body. The cap base body can have on its inner side, which is facing the applicator body in the closed condition, one or multiple, projections and/or recesses or respectively, grooves, which preferably are, respectively, arranged concentric on a perimeter around a length axes of the cap base body an which are preferably ring-shaped, oval or angular. Projections can form, in a preferred embodiment, an axial securing means for the applicator body, wherein in the projections delimit or prevent an axial movement of the applicator body in the closed condition, in particular tighten the applicator body against the receiver. In addition, or alternatively, said projections can serve, as explained before, for the mounting of a support, when the support has, for example, one or more recesses, which are plugged onto the projections by form-fit and, preferably also by frictional engagement.

In a preferred embodiment, the sealing element and/or the axial support or respectively, its part provide in combination a recess on a contact surface. This favors a joint mounting by material bond. In particular, one or multiple of such recesses can receive connecting elements, which, in the manner of a feather key, fixate the sealing element and the axial support or, respectively, its part, in particular during connecting, by material bond. Empty recesses, in contrast, can, for example, receive air, excess material or adhesive.

In preferred embodiment, the sealing element, which preferably is at least substantially disk-shaped, as explained before, has a ring-shaped flange area, which extends to the fluid body in the closed condition and which engages a fluid cap between the applicator body and the receiver at least in part, wherein it is preferably elastically deformed at the same time.

Further advantages, features and possibilities of applications of the present invention result from the following description in combination with the figures. There are shown, at least in part schematically:

FIG. 1A: a fluid container arrangement with a closure cap according to a first embodiment of the present invention, in a cross section;

FIG. 1B: a enlarged section of FIG. 1A;

FIG. 2A: a fluid container arrangement with the closure cap according to a second embodiment of the present invention in a view corresponding to FIG. 1A;

FIG. 2B: an enlarged section of FIG. 2A; and

FIG. 3: a fluid container arrangement with the closure cap according to a third embodiment of the present invention in a view corresponding to FIG. 1, 2A.

FIG. 1A shows a fluid container arrangement with a closure cap 1 according to a first embodiment of the present invention, in cross section.

The fluid container arrangement has a fluid container 30 with a release opening, in which is plugged an elastic receiver 31, in which is received, in a rotatably moveable manner, a sphere-shaped applicator body 32, herein after referred to as applicator ball. In particular, when the fluid container is arranged contrary to the illustration of FIG. 1A, upside-down, the fluid, for example a deodorant, in the inside of the fluid container 30, thus wets the area of the receiver ball 32, which is facing the inside. Once the applicator ball is rotated within its receiver, for example by frictional contact with the skin of a user in case of a removed closure cap 1, said wetted area comes into contact with the skin and thus release the fluid there, at least in part.

For the storing, in particular for the upside-down storing, as well as for the transport, the closure cap 1 can be removably mounted at the fluid container 30 by means of the fastening means 40, i.e. by complementary screw-threads at the fluid container 30 and the closure cap 1. The fluid container arrangement is closed this way. In a modification, not shown, the closure cap can additionally or alternatively be also removably mounted at the receiver, in an analogical manner.

The closure cap 1 has a cap base body 10 made from PP, which, in the embodiment, is formed substantially cup-shaped, having a flat outer front face, which favors the upside-down storage, and is formed with a ring-shaped jacket, which is following the front face. Other outer contours are also possible, for example a curved outer contour with distributed recesses or projections, which allow a stable upside-down storage.

The cap base body can have, on the side facing the applicator ball 32, a substantially planar inner front surface 11, which in the embodiment, is only slightly cone-shaped and which reduces in the direction away from the fluid container 30. At the inner front surface, a ring-shaped projection 12 is formed, which extends towards the applicator ball 32 and which secures the same axially, without touching the same in the laying condition.

Fluid container 30, receiver 31, applicator ball 32 and closure cap 1 are at least substantially, formed rotationally symmetric; the axis of symmetry is defined, as shown in dashed lines in FIG. 1A, from the fluid container 30 towards the closure cap 1, by the axial direction A.

At the cap base body 10 of the closure cap 1, an axial support 20 made from POM is mounted axially and rotationally fixated. The support is also substantially cup-shaped, having an area 21 (compare FIG. 1B), which extends substantially in parallel to the axial direction, and an area 21, which is substantially perpendicular to the axial direction and which has a central passage, which is surrounded by a ring flange 23. The ring flange 23 surrounds the ring-shaped projection 12 in a form-fit manner on the inner front surface 11 of the cap base body 10. In a modification, not shown, the flange and the projection can also have an oval, three-, four-, or multiple-angular cross section or a different cross section.

In a configuration, the axial support 20 is mounted rotationally and axially fixated and unmovable at the cap base body 10, as, for example, the ring flange 23 is glued to the projection 12 or fused with the same. In another configuration, the support 20 is mounted rotationally and axially fixated and removable at the cap base body 10, as, for example, the ring flange 23 is put on the projection 12 by frictional engagement. For this purpose, the inner diameter of the passage at the support 20 is slightly larger than the outer diameter of the projection 12. In case that the frictional engagement is only formed weak, the support 20 is mounted axially fixated, but mounted rotatably at the cap base body 10.

The ring-shaped projection 12 thereby has a double function, providing an axial securing of the applicator body 32 and providing a fastening means for the support 20.

Arranged axially in opposite, at the open edge 24, which is facing the applicator ball 32, of the cup-shaped axial support 20, a ring-disk-shaped sealing element 2 made from TPE is connected by material bond with the support 20. It has, as can be seen in particular in FIG. 1B, a ring flange 3, which is positioned inside and which extends towards the fluid container 30. The sealing element 2 with the ring flange 3 is engaging a fluid gap S between the receiver 31 and the applicator ball 32 in the closed condition.

The sealing element 2 is made from TPE, which is more elastic compared with the cap base body 10 made from PP. The dimensions of the sealing element 2 as well as the dimensions of the axial support 20 and the distance between the fastening means 40 and the inner front surface 11 are matching each other such that in the closed condition of the fluid container arrangement, in particular, the more elastic sealing element 2, in a preferred embodiment also the support 20, preferably in a reduced measure, are elastically deformed such that the cap base body 10, which is mounted at the fluid container 30, tightens the sealing element 2, for increasing its sealing effect. For the illustration in the figures the elements are shown in their undeformed reference condition, in which they do cross each other in part, while not showing the above mentioned elastic deformation.

The sealing element 2 contacts as well the applicator ball 32 as well as its receiver 31 (compare FIG. 1B). The ring-disk-shaped sealing element 2 has only a low axial lengths, which, in the embodiment, amounts to about 4 to 6 percent of the radius of the applicator ball. In combination with the stiffness of the support 20, which is positioned in series, a desired characteristics of sealing and closure can be adjusted.

For the fabrication, the sealing element 2, which is master-formed from TPE, is arranged in an injection mould, in which afterward POM is inserted to fabricate the axial support 20. Hereby, the sealing element 2 and the support 20 are directly connected to each other by material bond by means of injection to each other or, respectively, injection onto each other.

As can be seen, in particular, from the combination of the FIGS. 1A and 1B, a corresponding ring-section-shaped and groove-shaped recess 4 (in the sealing element 2) or, respectively, 25 (in the support 20) is formed, respectively, in the contact surfaces of the axial support 20 and the sealing element 2, which are facing each other, which recess is extending along a part of the circumference around an axial direction A. Hereby, a recess 4, 25 is defined in the contact area, in which recess a feather key is inserted, which fixates the support 20 and the sealing element in addition to the material bond in a form-fit manner to each other.

FIG. 2A, 2B show a fluid-container arrangement according to a second embodiment of the present invention, in a view corresponding to FIG. 1A, 1B. Matching features are provided with identical reference signs such that in the following only the differences in comparison with the first embodiment are explained.

In the second embodiment, the axial support 20, also referred to as the support base body, is comprised of multiple parts, including a connecting part 26. In the second embodiment, the support base body 20 includes the substantially axially parallel area 21 of the first embodiment, wherein, in one alternative of the second embodiment, the area 21, which is substantially parallel to the axial direction A, can be reduced in length according to about the thickness of the wall of the connecting part 26.

The connecting part 26 is substantially ring-disk-shaped and is made from PP. It is directly connected by material bond to the sealing element 2, according to the already described manner during the master-forming of the connecting part 26 by injecting to, or respectively, injecting onto the sealing element 2, which is inserted in the form. The connecting part is connected with the support base body 20, for example in a manner not shown, using a tongue-and-groove-connection for a form-fit connection and/or by adhering for a material bond connection. Likewise, also the connecting part 26 can be directly connected by material bond to the support base body 20, before or after connection with the sealing element 2, according to the before explained manner, by injecting to or, respectively, injecting onto the support base body 20 during the master-forming. This way, the support base body 20 and the sealing element 2 can advantageously mounted at each other even in the case that their respective materials are not appropriate for a direct material bond connection.

At the second embodiment, a ring-segment-shaped and groove-shaped recess 25 is only provided at the edge of 24 of the support base body 20, but not in the contact surface of the sealing element 2 or in one of the contact surfaces of the connecting part 26, for possibly receiving excess adhesive or material of the master-formed connection part 26, which than additionally fixates by form-fit the support base body and the connecting part as the tongue of a tongue-and-groove connection. Likewise, in modified embodiments, one or more recesses can be provided in at least one of that contact surfaces.

FIG. 3 shows a fluid container arrangement according to a third embodiment of the present invention in a view corresponding to FIG. 1A, 2A. Features, which match with the first or, respectively, the second embodiment, are provided with identical reference signs such that in the following only the differences to the first and the second embodiment are explained.

At the third embodiment, the axial support 20' is integrally formed with the cap base body 10 of the closure cap 1 as a radial bench, which supports the sealing element 2 in axial direction A between the axially foremost normal plane of the inner front surface 11 and the axially foremost contact surface of the sealing element. Also here, the sealing element 2 is connected to the support 20' by material bond, wherein it is inserted into the injection mould before the injection moulding of the cap base body 10 from PP.

In addition, in the third embodiment and in the closed condition, the ring-shaped projection 12 contacts the applicator ball and tightens the same axially against the receiver 31. Due to the elastically of the receiver 31 the sealing element is, likewise, tightened against the applicator ball 32 and the receiver 31 by screwing of the fastening means 40, and thereby elastically deformed.

The invention claimed is:

1. Method for the fabrication of a closure cap for a fluid container, which has a receiver, at which an applicator body is moveably supported, wherein the closure cap has a ring-disk-shaped sealing element with a ring-shaped flange area for engaging a fluid gap between the applicator body and the receiver and has a cap base body with an axial support, wherein the ring-disk-shaped sealing element and at least a part of the axial support are directly connected to each other by material bond without the use of adhesive, during a master-forming of the ring-disk-shaped sealing element and/or the at least one part of the axial support, by injection into one another or by injection onto each other, and the axial support is a multipart axial support, which has a support base body, which is connected to the cap base body, and a connection part made from another material than the support base body, to which connection part the ring-disk-shaped sealing element is connected by material bond.

2. Closure cap for a fluid container, which has a receiver, at which an applicator body is supported moveably, wherein the closure cap has a ring-disk-shaped sealing element with a ring-shaped flange area for engaging a fluid gap between the applicator body and the receiver and has a cap base body with an axial support, and, wherein the ring-disk-shaped sealing element and at least a part of the axial support are directly connected to each other by material bond without the use of adhesive, during a master-forming of the ring-disk-shaped sealing element and/or the at least one part of the axial support, by injection into one another or by injection onto each other, and the axial support is a multipart axial support, which has a support base body, which is connected to the cap base body, and a connection part made from another material than the support base body, to which connection part the ring-disk-shaped sealing element is connected by material bond.

3. Closure cap according to claim 2, wherein the axial support is permanently connected with the cap base body, and formed integral with the same.

4. Closure cap according to claim 2, wherein the sealing element comprises at least one of thermoplastic elastomer (TPE) and/or silicone.

5. Closure cap according to claim 2, wherein the axial support comprises polyoxymethylene (POM) or polypropylene (PP).

6. Closure cap according to claim 2, wherein the axial support is elastically deformed when the closure cap is in the closed position.

7. Closure cap according to claim 2, wherein the ring-disk-shaped sealing element or the axial support has a recess located on a contact surface and the other one of the ring-disk-shaped sealing element and the axial support has a recess configured to receive a connecting element received therein.

8. Closure cap according to claim 2, wherein the closure cap has an axial securing means for the applicator body, at which the axial support is mounted.

9. Closure cap according to claim 2, wherein the closure cap is removably mountable on the fluid container or the receiver.

10. Closure cap for a fluid container, which has a receiver, at which an applicator body is supported moveably, wherein the closure cap has a ring-disk-shaped sealing element with a ring-shaped flange area for engaging a fluid gap between the applicator body and the receiver and has a cap base body with an axial support, and wherein the ring-disk-shaped sealing element and at least a part of the axial support are connected to each other by material bond, wherein:

the axial support is permanently connected with the cap base body, and formed integral with the same;

the ring-disk-shaped sealing element comprises at least one of thermoplastic elastomer (TPE) and silicone;

the axial support comprises at least one of thermoplastic, in particular polyoxymethylene (POM) and polypropylene (PP);

the axial support is elastically deformed when the closure cap is in the closed position;

the ring-disk-shaped sealing element is formed, at least substantially, disk-shaped or has a flange area for engaging a fluid gap between the applicator body and the receiver;

at least one of the ring-disk-shaped sealing element or the axial support has a recess located on a contact surface and the other one of the ring-disk-shaped sealing element and the axial support has a recess configured to receive a connecting element therein;

the closure cap has an axial securing means for the applicator body, at which the axial support is mounted; and the closure cap is removably mountable on the fluid container or the receiver.

11. Closure cap according to claim 2, wherein the closure cap has an axis of symmetry about which the ring-shaped flange area, the axial support, and the ring-disk-shaped sealing element are symmetrically disposed, and wherein the axial support is comprised at least of a first part which extends substantially perpendicularly to the axis of symmetry of the closure cap and a second part which extends substantially in parallel to the axis of symmetry of the closure cap.

* * * * *